US005989734A

United States Patent [19]

Miura et al.

[11] Patent Number: 5,989,734

[45] Date of Patent: Nov. 23, 1999

[54] ALUMINUM PRODUCT HAVING METAL DIFFUSION LAYER, PROCESS FOR PRODUCING THE SAME, AND PASTE FOR METAL DIFFUSION TREATMENT

[75] Inventors: Hirohisa Miura, Okazaki; Nagayoshi Matsubara, Aichi-gun; Yasuhiro Yamada, Tajima; Haruzo Katoh, Akashi; Takashi Watsuji, Yokaichi, all of Japan

[73] Assignees: Toyota Jidosha Kabushiki Kaisha, Aichin-ken, Japan; Toyo Aluminum Kabushiki Kaisha, Osaka-fu, Japan

[21] Appl. No.: 08/934,754

[22] Filed: Sep. 22, 1997

[30] Foreign Application Priority Data

Sep. 30, 1996 [JP] Japan ..... 8-260025

[51] Int. Cl.[6] ..... B32B 15/00

[52] U.S. Cl. ..... 428/656; 148/317

[58] Field of Search ..... 428/650, 651, 428/652, 656, 548, 553, 555; 148/238, 317, 240, 24; 228/244

[56] References Cited

U.S. PATENT DOCUMENTS

| | | | |
|---|---|---|---|
| 3,390,970 | 7/1968 | Bothwell . | |
| 5,514,225 | 5/1996 | Yamada et al. . | |
| 5,582,655 | 12/1996 | Yamada et al. | 148/317 |

FOREIGN PATENT DOCUMENTS

| | | |
|---|---|---|
| 0-666-334 | 8/1995 | European Pat. Off. . |
| 49-119838 | 11/1974 | Japan . |
| 50-5232 | 1/1975 | Japan . |
| 56-127767 | 10/1981 | Japan . |
| 5-331627 | 12/1993 | Japan . |
| 7-166321 | 6/1995 | Japan . |
| 7-292454 | 11/1995 | Japan . |
| 8-269682 | 10/1996 | Japan . |
| 26-066 | 5/1982 | U.S.S.R. . |
| 1-019-009 | 5/1983 | U.S.S.R. . |
| 498-371 | 1/1939 | United Kingdom . |
| 983-231 | 2/1965 | United Kingdom . |

OTHER PUBLICATIONS

Abstract, SU–A–722–994, Derwent Publications Ltd., London, GB, Section Ch, Week 8044, Mar. 1980.

*Primary Examiner*—Deborah Jones
*Assistant Examiner*—Darlene David
*Attorney, Agent, or Firm*—Oliff & Berridge, PLC

[57] ABSTRACT

An aluminum product having the metal diffusion layer in the present invention has, on the surface thereof, a metal diffusion layer comprising aluminum and a diffusion metal which is diffused setting aluminum as a matrix and which includes at least one selected from the group consisting of Ni, Cr, Cu, Zn, Mg, Ti and Ag; wherein the diffusion layer is formed by diffusing inclinatorily not less than 1 μm from the surface thereof; and the diffusion metal is not less than 1.0% by weight when the whole of the metal diffusion layer is set to be 100% by weight. Also, in a process for producing an aluminum product having a metal diffusion layer, the surface of the aluminum product is brought into contact with the processing agent including at least the diffusion metal powder; and in this state by conducting heat treatment in the atmosphere including nitrogen, the diffusion metal is diffused on the surface of the aluminum product and the metal diffusion layer is formed. Thus, the present invention supplies the aluminum product having the metal diffusion layer on the surface thereof and the process for producing the aluminum product having this kind of metal diffusion layer on the surface thereof.

9 Claims, 5 Drawing Sheets

ALUMINUM PRODUCT HAVING METAL DIFFUSION LAYER, PROCESS FOR PRODUCING THE SAME, AND PASTE FOR METAL DIFFUSION TREATMENT

BACKGROUND OF THE INVENTION

1. Field of the Invention

The present invention relates to an aluminum product having a metal diffusion layer on the surface thereof by a metal diffusion treatment; a process for producing the same; and a paste for metal diffusion treatment.

2. Description of the Related Art

Aluminum forms intermetallic compounds such as $CrAl_7$, $CuAl_2$, $Mg_2AL_3$, $TiAl_3$, $NiAl_3$ by combining with chromium, copper magnesium, titanium and nickel respectively. These intermetallic compounds have been known that they are hard and superior in heat resistance.

If two kinds of metal plates are kept at high temperature being contacted, metallic atoms at one of each metallic plate on the contact surface thereof diffuse to a surface portion of the other metallic plate so that an intermetallic compound is theoretically formed on each of metallic plates by this mutual diffusion. However, at around the temperature of 550° C., a mutual diffusion of aluminum and the other metal has extremely small mutual diffusion speed ranging from $10^{-12}$ to $10^{-18}$ $m^2$/sec. so that it is almost impossible to form a metal diffusion layer only by mutual diffusion practically. Furthermore, it has been tried that the other metallic layer is formed on the surface of the aluminum product by thermal spraying, however, it has not been obtained that dissimilar metals diffuse inclinatorily not less than 1 $\mu$m from the surface of the aluminum product and also, the aluminum product includes a metal diffusion layer, on the surface thereof, comprising a diffusing metal being not less than 1.0% by weight.

On the other hand, the present inventors disclose the following method in Japanese Patent Application (TOKUGAN) No. 7-100184: getting a nitriding agent into contact with at least on one part of the surface of the aluminum product, wherein the nitriding agent comprises a metal powder including at least one selected from the group consisting of titanium, chromium, silicon, iron, manganese, nickel, vanadium, tantalum, magnesium, boron and zirconium as a major component; and in this state, nitriding the surface of the aluminum product by an ambient gas comprising substantially gaseous nitrogen at a temperature of a melting point of the aluminum product or less. The purpose of this procedure is to obtain a thick nitriding layer on the surface of the aluminum product. In this procedure, the metal powder used as the nitriding agent is subjected to nitriding and becomes a nitrided metal, however it is not diffused into the inside of aluminum.

Furthermore, the present inventors disclose the following method in Japanese Unexamined Patent Publication (KOKAI) No. 7-166321: getting a nitriding agent which is composed of an aluminum powder into contact with at least one part of the surface of the aluminum product; and in this state, nitriding the surface of the aluminum product by an ambient gas comprising substantially gaseous nitrogen at a temperature of a melting point of the aluminum product or less. In this method, a pure aluminum powder or an aluminum product including magnesium a little is recommended to be used as nitriding agent and the purpose of this method is to obtain the nitriding layer at the inside of aluminum.

Furthermore, the present inventors disclose the following product in Japanese Unexamined Patent Publication (KOKAI) No. 7-292454: a case treated aluminum product comprising an aluminum matrix, a diffusion layer formed by diffusion of nitrogen in the aluminum-matrix which is formed at the surface portion of the aluminum matrix, a sintered layer which is formed by sintering of mainly a nitrided aluminum powder which is formed on the upper surface of the diffused layer. Also, in this publication, the present inventors, at the same time, disclose the case treated aluminum product which exists by making compound by conducting diffusion and penetration of nitrogen and other elements except for nitrogen in the diffused layer, however the treatment method thereof is poor and in the treatment method in which titanium powder is used, the amount of titanium which exists in the diffusion layer is extremely little, and the result thereof is not satisfactory in actual use.

SUMMARY OF THE INVENTION

The present invention has been developed in view of the above-mentioned circumstances. It is therefore an object of the present invention to provide an aluminum product comprising a metal diffusion layer formed by diffusion of a diffusion metal which includes at least one selected from the group consisting of Ni, Cr, Cu, Zn, Mg, Ti and Ag inclinatorily not less than 1 $\mu$m from the surface of the aluminum product; and comprising at least 1.0% by weight of the diffusion metal when the whole of the metal diffusion layer is set to be 100% by weight; and also, a process for producing the aluminum product which includes the above-mentioned metal diffusion layer on the surface thereof; and a paste for metal diffusion treatment.

At the state when the present inventors have studied the nitriding treatment method of the aluminum product, the present inventions have discovered the following phenomena: in the case when nitrogen is diffused into the inside from the surface of the aluminum product by strong force by using a nitriding agent, for example, when the aluminum matrix includes Mg, there arises rapid mutual diffusion from the inside of magnesium to the surface thereof; and when the aluminum matrix includes silicon, there arises rapid mutual diffusion into the inside of the matrix of Mg in the nitriding agent; such rapid diffusion is mutual diffusion which is hardly considered to be to be occurred in prior arts.

Based on these views, the present invention was conducted that is, (1) if a diffusion metal such as Ni, Cr, Cu, Zn, Mg, Ti and Ag is placed at the place where nitrogen is diffused in the inside thereof by strong force, this diffusion metal is forced into the inside thereof by strong force accompanied by the diffusion of nitrogen; (2) if magnesium alloy is used as a metal paste of the surface of the aluminum product, a metal which forms alloy together with magnesium is also forced into the inside thereof; (3) if the alloy which is used as a metal paste has lower melting point, it is more easy to be diffused. Based on these views, the present inventors have developed the metal diffusion treatment method of aluminum which has relatively high speed.

Furthermore, the present inventors have found the following effects of the present invention: the aluminum product comprises aluminum and a diffusion metal which comprises at least one selected from the group consisting of Ni, Cr, Cu, Zn, Mg, Ti and Ag and which diffuses in aluminum as a matrix; this diffusion metal diffuses inclinatorily not less than 1 $\mu$m from the surface thereof; when the whole weight of the metal diffusion layer is set to be 100% by weight, the aluminum product has, on the surface thereof, a metal diffusion layer including not less than 1.0% by weight of diffusion metal; and such a kind of aluminum product is superior in bright property and fresh in tone of color; and furthermore, by coexisting the metal diffusion layer together with nitrogen, our inventors have found that the aluminum product which is superior in wear resistance, heat resistance and corrosion resistance can be obtained and therefore, the present invention has been developed.

Namely, the aluminum product having the metal diffusion layer in the present invention has, on the surface thereof, a metal diffusion layer comprising aluminum and a diffusion metal which is diffused setting aluminum as a matrix and which includes at least one selected from the group consisting of Ni, Cr, Cu, Zn, Mg, Ti and Ag; wherein the diffusion layer is formed by diffusing the diffusion metal inclinatorily not less than 1 $\mu$m from the surface thereof; and the diffusion metal is not less than 1.0% by weight when the whole of the metal diffusion layer is set to be 100% by weight.

Furthermore, the process for producing the aluminum product having the metal diffusion layer in the present invention is the process for producing the aluminum product having, on the surface thereof, a metal diffusion layer comprising aluminum and a diffusion metal which is diffused setting aluminum as a matrix and which includes at least one selected from the group consisting of Ni, Cr, Cu, Zn, Mg, Ti and Ag. The process of the present invention comprises the steps of: a contacting process for bringing the surface of the aluminum product into contact with processing agent including at least the diffusion metal powder; and a heat treatment process for conducting heat treatment of the aluminum product with which the processing agent is brought into contact in the atmosphere including nitrogen, so that the diffusion metal is diffused on the surface of the aluminum product and the metal diffusion layer is formed.

Furthermore, the paste for metal diffusion treatment comprises: a metal powder in an amount of 5 to 70% by weight including at least one kind or more of the diffusion metals, an organic substance for binder in an amount of 1 to 30% by weight and the balance of solvent substantially.

The aluminum product having the metal diffusion layer in the present invention is the aluminum product comprising aluminum matrix and the metal diffusion layer.

The aluminum matrix used in the present invention is not defined as pure aluminum and aluminum alloy including elements such as magnesium and silicon may be adopted.

Also, the metal diffusion layer comprises: aluminum and the diffusion metal which is diffused setting aluminum as a matrix and which includes at least one selected from the group consisting of Ni, Cr, Cu, Zn, Mg, Ti and Ag; wherein the diffusion layer is formed by diffusing the diffusion metal inclinatorily not less than 1 $\mu$m from the surface thereof; and the diffusion metal is not less than 1.0% by weight when the whole of the metal diffusion layer is set to be 100% by weight.

This metal diffusion layer is formed by diffusing the diffusion metal inclinatorily to aluminum as the matrix so that aluminum which becomes this matrix forms the strong metal bonding with aluminum in the aluminum matrix layer. Owing to this strong metal bonding among aluminum each other, the metal diffusion layer and the aluminum matrix layer is strongly bonded at the boundary portion thereof.

This metal diffusion layer has different color development compared with the color of aluminum; therefore, by forming this kind of metal diffusion layer is formed on the surface of the aluminum matrix, it is possible that the aluminum product can develop the different color tone of metallic gloss compared with that of aluminum. At this time, by selecting the diffusion metal, it is possible to obtain the desired tone of color on the surface thereof, to be concrete, tones of color such as light golden color, orange color, black color and silver color can be obtained. Furthermore, by including more than two kinds of diffusion metals at an arbitrary ratio, or combining a metal diffusion layer including different diffusion metals, it is possible to obtain the desired color of the surface thereof. Furthermore, by selecting irregularity of the surface thereof, it is possible to obtain the desired light reflecting property.

Furthermore, in this metal diffusion layer, it is desired that nitrogen exists together. This nitrogen forms nitride together with aluminum and the diffusion metal of the aluminum product so that the metal diffusion layer is superior in wear resistance, heat resistance and corrosion resistance. For example, aluminum nitride is hard and its melting point is high so that the wear resistance and heat resistance of the metal diffusion layer is improved. Also, chromium nitride and titanium nitride is strongly resistant to not only water but the acids and the alkalis so that the corrosion resistance of the metal diffusion layer is improved.

Among these metal diffusion layers, the layer in which diffusion metal is not diffused inclinatorily not less than 1 $\mu$m from the surface thereof, or the layer in which the diffusion metal is not less than 1.0% by weight when the whole of the metal diffusion layer is set to be 100% by weight does not have enough thickness of the metal diffusion layer and enough diffusion amount of the diffusion metal, so that it is impossible to develop the desired tone of color which is different from the color development of aluminum and it is impossible to obtain the metal diffusion layer which is superior in wear resistance, heat resistance and corrosion resistance.

The process for producing the aluminum product having the metal diffusion layer of the present invention is the process for producing the aluminum product having the metal diffusion layer, on the surface thereof, comprising aluminum and a diffusion metal which is diffused setting aluminum as a matrix and which includes at least one selected from the group consisting of Ni, Cr, Cu, Zn, Mg, Ti and Ag; and this process comprises two steps of the contacting process and the heat treatment process.

The contacting process is to bring the surface of the aluminum product into contact with processing agent including a diffusion metal powder comprising at least one selected from the group consisting of Ni, Cr, Cu, Zn, Mg, Ti and Ag.

As the aluminum product used in this procedure, aluminum product composed of pure aluminum, aluminum product composed of aluminum alloy including elements such as magnesium, silicon can be used as aluminum base material for being treated. Furthermore, the processing agent is not specially defined so that the processing agent including alloy powder which includes diffusion metal can be used. Also, the shapes of these powders are not especially defined, therefore, compressed shaped flakes which were crushed by ball mill can be used.

It is desired that this processing agent includes an alloy powder of the above-mentioned diffusion metal whose melting point is lower than that of the diffusion metal. The alloy powder of the diffusion metal having lower melting point has the following good effects: it is easy to be diffused on the surface portion of the aluminum base material for being treated so that it is possible to reduce the heat treatment temperature at which the diffusion metal diffuses effectively.

Furthermore, it is desired that this alloy powder has the melting point ranging from 350 to 600° C., and more preferably the melting point ranging from 400 to 550° C. By using these alloy powders, it is possible that the diffusion metal is effectively diffused on the surface portion of the aluminum base material for being treated at the heat treatment temperature ranging from 350 to 600° C.

Furthermore, it is desired that the alloy included in these alloy powders is an alloy of the diffusion metal and Mg or Al. If a magnesium alloy is used, a metal which forms the alloy together with magnesium is forced in the inside of the aluminum base material for being treated together with magnesium. Also, many of these alloys are eutectic alloys; and by becoming eutectic crystals, their melting points are remarkably reduced compared with those of a single metal. Even in the case of a peritectic alloy, the melting point thereof is lower compared with that of a metallic simple substance which has a higher melting point so that it is advantageous to conduct its diffusion. Table 1 shows the melting points of metallic simple substances and the melting point of the alloy composition by referring a part of examples.

| NAME OF METAL | MELTING POINT (° C.) | NAME OF ALLOY | MELTING POINT (° C.) |
|---|---|---|---|
| Al | 660 | Mg - (32.3 ~ 64.5)% by weight Al | 437 ~ 462 |
| Mg | 649 | Mg - (30 ~ 60)% by weight Zn | 343 ~ 540 |
| Ag | 961 | Mg - 48.5% by weight Ag | 471 |
| Cu | 1083 | Mg - 30.7% by weight Cu | 485 |
| Ni | 1453 | Mg - 23.5% by weight Ni | 507 |
| Zn | 420 | Al - 33.0% by weight Cu | 548 |
| Ti | 1670 | Al - 32.3% by weight Mg - 4% by weight Cu | 450 |
| | | Al - 37% by weight Ti | 1340 |

Moreover, a part of ternary alloys including aluminum and magnesium is described in the above-mentioned Table 1. All of alloys shown in Table 1 have the melting points ranging from 350 to 600° C. Also as a ternary alloy including Al and Mg, besides Al-32.3Mg-4Cu alloy including Cu, Al—Mg—Zn, Al—Mg—Ni and so on including Zn and Ni have the lower melting points.

Accordingly, by using the alloy of the diffusion metal and Mg or Al, its melting point is lower than that of the diffusion metal and melting point thereof may range from from 350 to 600° C.

It is possible that besides these diffusion metal powders, an Al metal powder is mixed into the processing agent. An Al metal powder has a strong effect to activate nitrogen so that the diffusion of the diffusion metal is promoted.

Furthermore, in this process, it is desired that the processing agent should attach firmly the diffusion metal powder to the surface of the aluminum base material for being treated. Also it is desired that the diffusion metal powder which is attached to the aluminum base material for being treated should comprise porous holes so as to supply gaseous nitrogen on the surface of the aluminum base material for being treated. Accordingly, the processing agent is a paste including a metal powder which comprises the above-mentioned diffusion metal and an organic substance for binder, and it is desired that the processing agent is used to be coated on the surface of the aluminum base material for being treated. The paste can be prepared by the metal powder including the diffusion metal, resin for binder and solvent. It is desired that resin which decompose at the treatment temperature is selected as the resin for binder.

At this time, the method to apply the paste on the surface of the aluminum base material for being treated is not especially defined, however, applying can be conducted by dipping or injection. Also, the applying thickness is not especially defined; however, the thickness thereof may be selected in response to the composition of the paste, layer thickness of the metal diffusion layer which forms and the content of the diffusion metal; and the thickness of the processing agent which is formed preferably ranges from 5 to 1000 $\mu$m.

In the heat treatment process, by conducting the heat treatment of the aluminum base material for being treated to which the processing agent is contacted in the atmosphere including nitrogen, the above-mentioned diffusion metal is diffused on the surface of the aluminum base material for being treated so that the metal diffusion layer is formed. In this process, the diffusion metal which is composed of at least one selected from the group consisting of Ni, Cr, Cu, Zn, Mg, Ti and Ag included in the processing agent reacts with gaseous nitrogen; the nascent nitrogen (N*) is penetrated into the inside from the surface of the aluminum base material for being treated; and at the same time, the metallic component also can be diffused to the inside.

At this time, the atmosphere including nitrogen is preferably to be pure gaseous nitrogen. By setting nitrogen atmosphere, in this way, the amount of diffusion of nitrogen is increased. At this time, accompanying the increase of diffusion amount of nitrogen, it is possible to increase the diffusion amount of the diffusion metal.

It is desired that the heat treatment temperature ranges from 400 to 600° C. By conducting heat treatment at the temperature in the above-mentioned range, the aluminum base material for being treated can be heated enough so as to diffuse the diffusion metal; and also it is possible that the diffusion metal is diffused effectively without reducing the quality of the aluminum base material for being treated.

Furthermore, the time for heat treatment is not especially defined, however it can be selected in response to the layer thickness of the metal diffusion layer which forms and the content of the diffusion metal.

By selecting the kinds of the diffusion metals or the aluminum product which is superior in smoothing property on the surface thereof, the aluminum product having the metal diffusion layer in the present invention can have the arbitrary tones of color such as light golden color, orange color, black color and silver color and can obtain the surface which is superior in light reflecting property so that the aluminum product of the present invention is superior in brightness and fresh in tone of color. Furthermore, the surface of the arbitrary tone of color can be obtained so that it is possible that design which is full of color can be organized on the surface thereof.

Scientifically, brightness is defined as the amount of reflecting to a certain wave length of light, however, brightness here indicates gloss of metal which is usually used in plating.

Moreover, by coexisting nitrogen in the metal diffusion layer, the aluminum product of the present invention becomes the aluminum product having a metal diffusion layer which is superior in wear resistance, heat resistance and corrosion resistance.

Furthermore, in the case when the thickness of the metal diffusion layer is large, by the difference between the coefficients of thermal expansion of the aluminum base material and the metal diffusion layer, there is a possibility that the peeling may occur at the boundary surface thereof. In the aluminum product having the metal diffusion layer on the surface thereof in the present invention, the metal diffusion layer and the aluminum base material layer are strongly bonded together so that peeling of the metal diffusion layer hardly occurs.

In the process for producing the aluminum product having the metal diffusion layer of the present invention, it is possible that the diffusion metal is easily and rapidly diffused on the surface of the aluminum base material for being treated; so that the aluminum product having the metal diffusion layer can be produced easily and at a short period of time.

Furthermore, depending on the composition of the processing agent, heating temperature and heat treatment conditions such as nitrogen pressure, it is possible that the thickness of the metal diffusion layer and the content of the diffusion metal is changed arbitrarily.

The aluminum product having the metal diffusion layer of the present invention is the aluminum product which is superior in bright property and fresh in tone of color so that it can be utilized as the materials such as parts of ornament product.

Furthermore the aluminum product having the metal diffusion layer can be the aluminum product which is superior in wear resistance, heat resistance and corrosion resistance so that it can be utilized as the materials such as parts of automobiles or household electric appliances which require wear resistance, heat resistance and corrosion resistance.

Moreover, the aluminum product has a small amount of specific density and a large amount of mechanical strength so that the product is light in weight and strongly-built.

Also, by the process for producing the aluminum product having the metal diffusion layer of the present invention, it is possible to produce the aluminum product which is superior in bright property and fresh in tone of color and which is superior in wear resistance, heat resistance and corrosion resistance easily and at a short period of time.

DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

(Preparation of Metal paste)

Alloy powders having the composition which are shown in Table 2 were prepared by an ordinary atomize method or by grinding by micro grinder from the casting material of a necessary composition. Next, after screening these alloy powders by 150 mesh, the obtained alloy powders were blended with ethyl cellulose N-7 (produced by Hercules Co., Ltd.) and butyl di-glycol solvent (produced by Nippon Nyukazai Co., Ltd.) so that metal pastes No. 1 to 6 were prepared. The blending ratios at this time were set as follows: when the whole of metal paste is set to be 100% by weight, alloy powder is 30.0% by weight, ethyl cellulose N-7 is 10.0% by weight and butyl di-glycol solvent is 60.0% by weight.

| METALLIC PASTE | METAL COMPOSITION |
|---|---|
| No. 1 | Mg - 52% by weight Zn (casting material grinding) |
| No. 2 | Mg - 50% by weight Al (powder on the market) |
| No. 3 | Al - 37% by weight Ti (combustion synthesis crushing) |
| No. 4 | Al - 33% by weight Cu (air · atomize powder) |
| No. 5 | Al - 8% by weight Ni (air · atomize powder) |
| No. 6 | Al - 2.5% by weight Mg (nitrogen atomize powder) |

(Operation of Metal Diffusion Treatment)

As the aluminum base material for being treated, from an aluminum alloy plate on the market (JIS1100,5052) or a casting raw material (JIS, AC2B), a specimen whose size is 80 mm×80 mm and whose thickness is 8 mm was cut down and the top surface thereof was subjected to polishing processing.

After applying the above-mentioned various metal pastes on the polishing surface of this aluminum material for being treated so as to get the drying film thickness thereof being 45 $\mu$m respectively, they were dried at the temperature of 80° C. While the obtained products which were dried enough were placed in the ordinary ring furnace for experiment ($\phi$100×1000), a pure nitrogen gas containing 99.99% $N_2$ was introduced into the furnace at a flow of 4 liters/min., and dew point was held at the temperature which is not more than −50° C., the heat treatment for 10 hours was conducted respectively at the predetermined treatment temperature.

(Evaluation Method)

The surfaces of the obtained aluminum products were observed and the aluminum products were subjected to an EPMA in order to examine the surface portion from the surface of the processing agent for their treated products. Furthermore, the Vickers hardness from the surface was measured.

FIRST PREFERRED EMBODIMENT

As the aluminum base material for being treated, a pure aluminum plate (JIS1100) was used; as a metal paste, a metal paste No. 1 was used; and heat treatment was conducted at the temperature of 500° C. for 10 hours.

Figure 1:
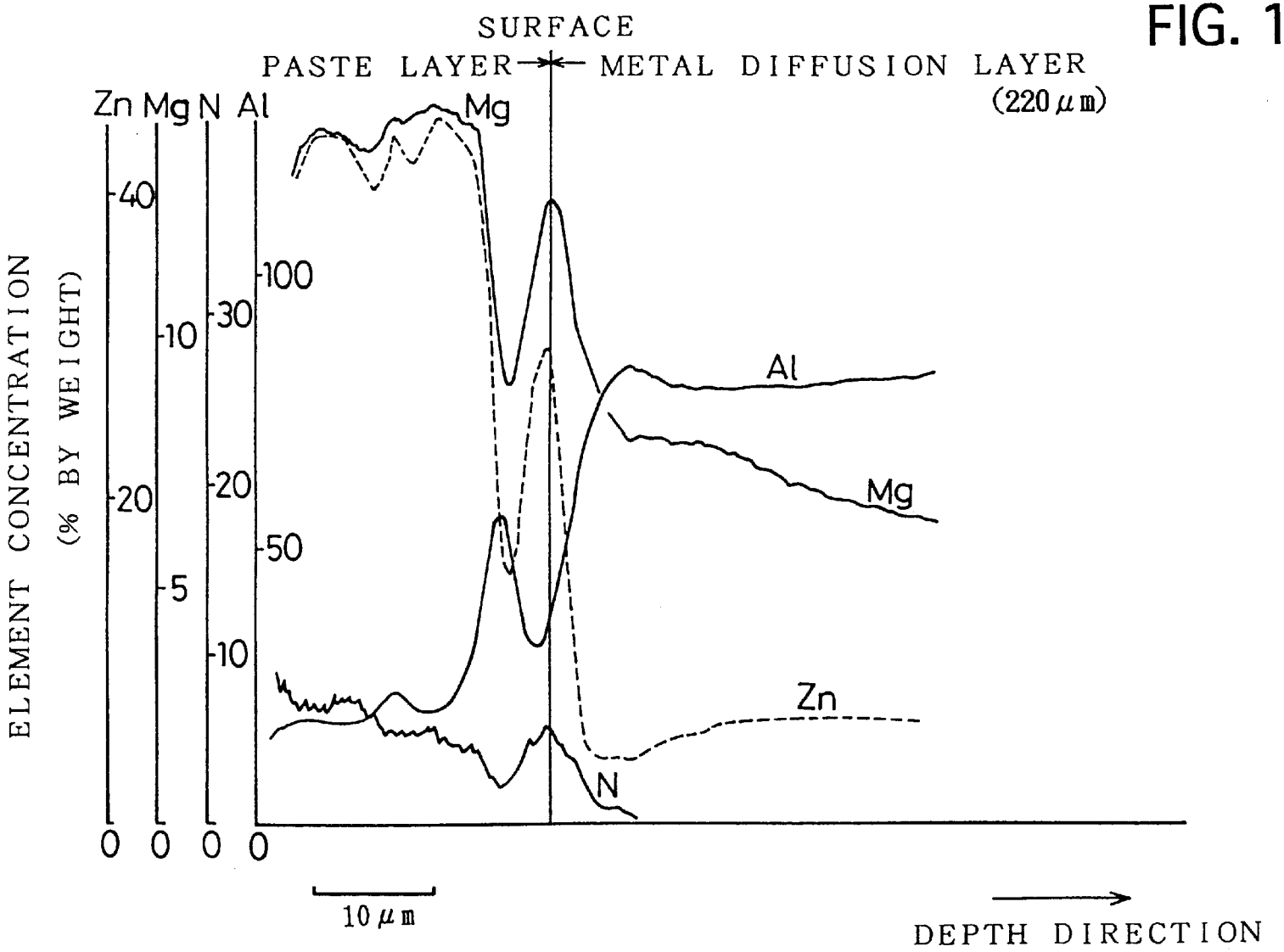
FIG. 1 is a chart for illustrating results of an EPMA, from the surface of the processing agent, to which the aluminum product having the metal diffusion layer obtained in a First Preferred Embodiment of the present invention was subjected.

It was found that the surface of the obtained aluminum product has a brightness property of brownish black. The resulting EPMA chart from the surface of the processing agent is shown in FIG. 1. As can be seen from FIG. 1, when the whole of the metal diffusion layer is set to be 100% by weight, it was found that a magnesium layer whose concentration is 12% by weight follows to the inside thereof in the metal diffusion layer. It was also found that a zinc layer of about 10% by weight follows to the inside thereof.

In the measurement result of hardness from the surface thereof, at the uppermost surface whose hardness is about Hv322 and at the portion of 200 $\mu$m from the surface, the hardness thereof still shows Hv156 so that the hardness of the metal diffusion layer is considered to be more than the above-mentioned hardness. The matrix hardness at the inside is about Hv36. The amount of nitrogen is about 2% by weight at most and even in the paste layer, the amount of nitrogen is low being 9% by weight.

SECOND PREFERRED EMBODIMENT

As the aluminum base material for being treated, an aluminum 7% by weight Si plate (JISAC2C) was used; as a metal paste, a metal paste No. 2 was used; and heat treatment was conducted at the temperature of 520° C. for 10 hours.

Figure 2:
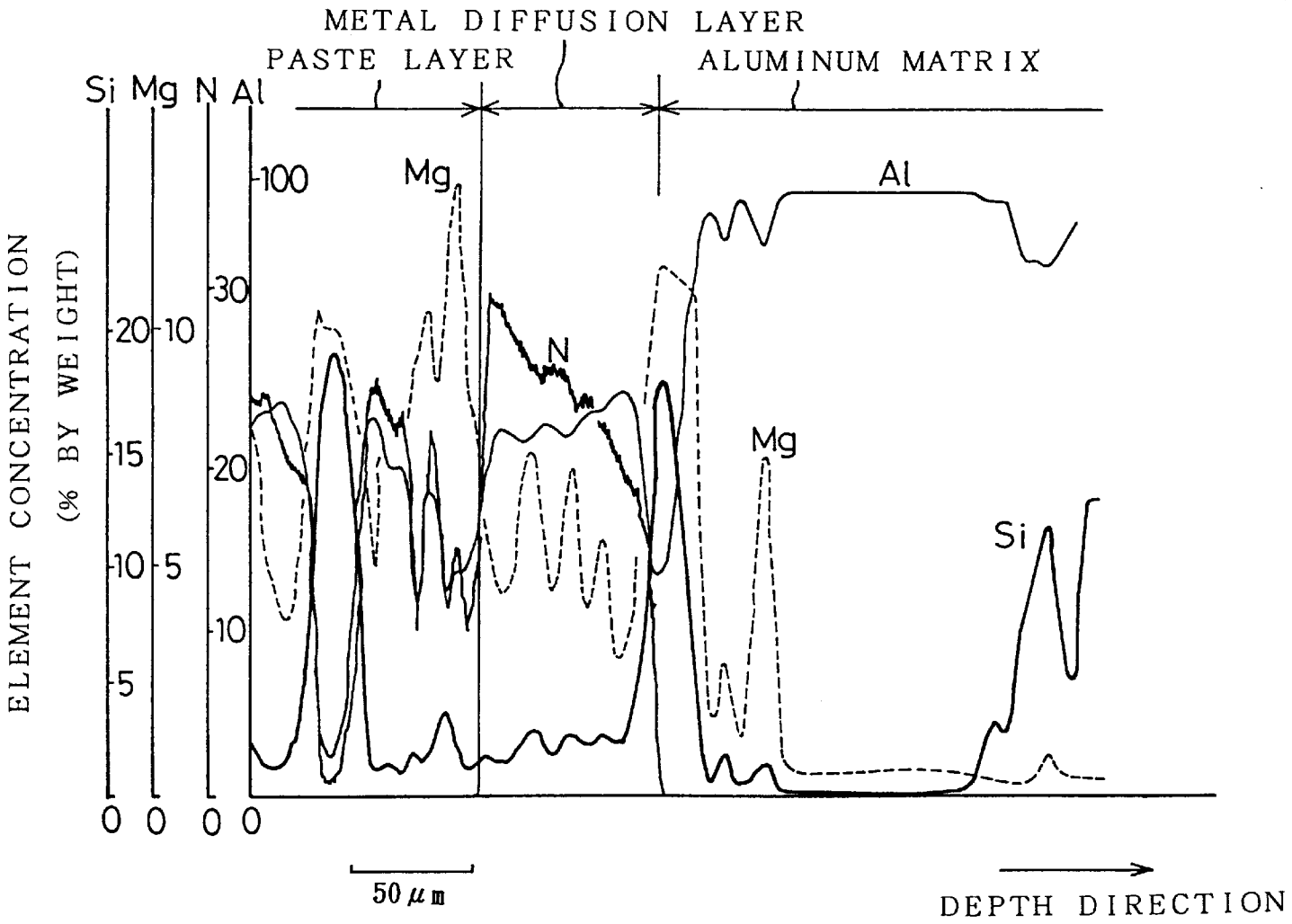
FIG. 2 is a chart for illustrating results of an EPMA, from the surface of the processing agent, to which the aluminum product having the metal diffusion layer obtained in a Second Preferred Embodiment of the present invention was subjected.

It was found that the surface of the obtained aluminum product has a brightness property of light gold color. The resulting EPMA chart from the surface of the processing agent is shown in FIG. 2. As can be seen from FIG. 2, when the whole of the metal diffusion layer is set to be 100% by weight, it was found that a magnesium layer (depth; 80 $\mu$m) of 3 to 10% by weight exists varying the content thereof. Furthermore, it was found that there exists the nitriding layer whose width is almost the same as that of the metal diffusion layer and whose nitrogen concentration is about 28% by weight at the uppermost surface layer. As is from the linear distribution of silicon, it was found that silicon exists 18% by weight at the maximum at the boundary of the metal diffusion surface and the matrix; silicon exists 2 to 4% at the inside of the metal diffusion layer; and silicon corresponds to the variation of the amount of magnesium. It is understood that this forms $Mg_2Si$.

THIRD PREFERRED EMBODIMENT

As the aluminum base material for being treated, an aluminum alloy plate (JIS5052) was used; as a metal paste, a metal paste No. 3 was used; and heat treatment was conducted at the temperature of 515° C.; and thus metal diffusion treatment was conducted.

Figure 3:
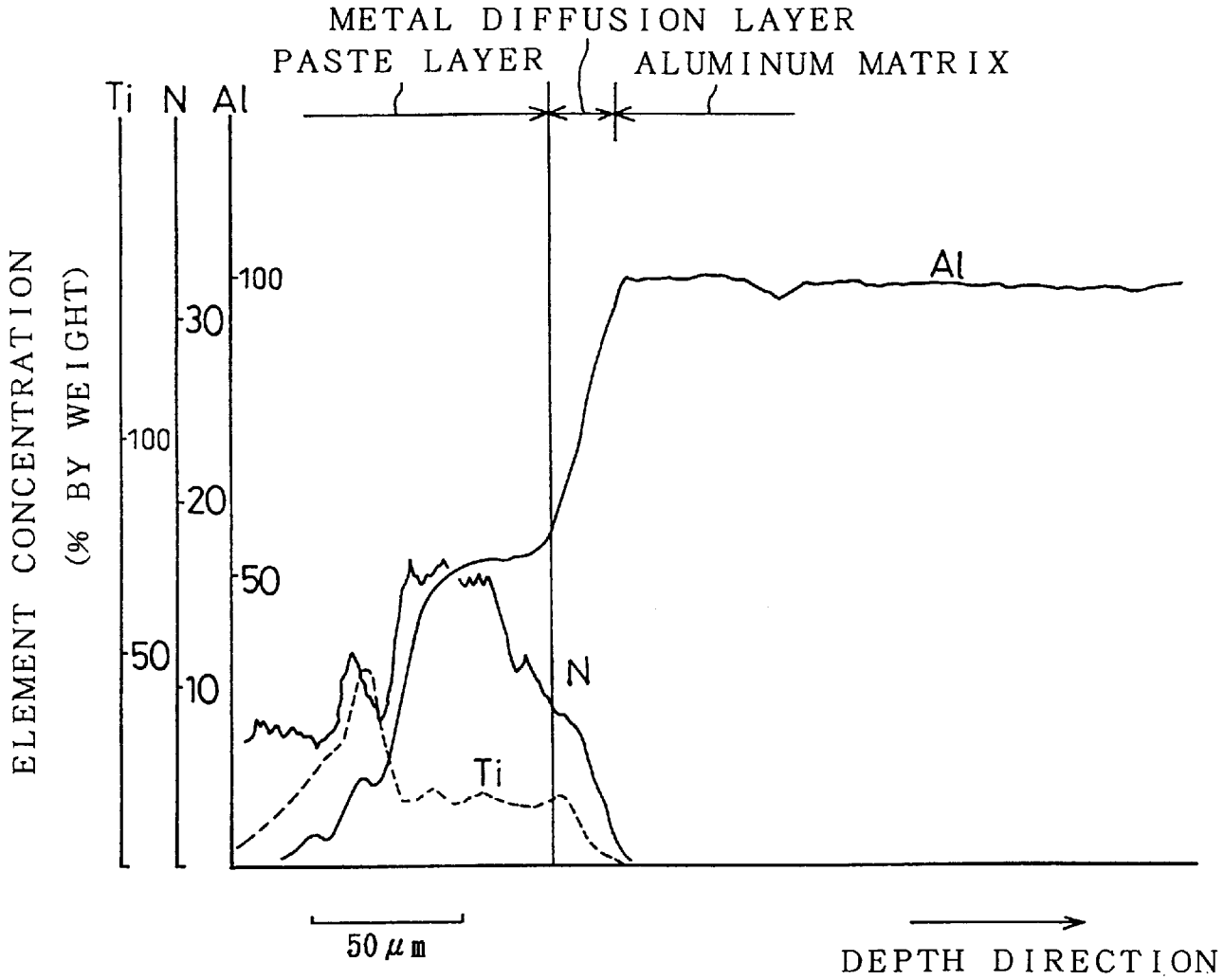
FIG. 3 is a chart for illustrating results of an EPMA, from the surface of the processing agent, to which the aluminum product having the metal diffusion layer obtained in a Third Preferred Embodiment of the present invention was subjected.

It was found that the surface of the obtained aluminum product has a brightness property of light silver color. The resulting EPMA chart from the surface of the treatment agent is shown in FIG. 3. As can be seen from FIG. 3, when the whole of the metal diffusion layer is set to be 100% by weight, it was found that the amount of Ti is 12% by weight at the uppermost surface thereof and there exists Ti layer (depth; 20 $\mu$m which gradually inclines at the inside thereof. Furthermore, it was found that there exists the nitriding layer whose width thereof is almost the same as that of this metal diffusion layer and whose nitrogen concentration is about 10% by weight at the uppermost surface layer. The hardness of the uppermost surface is high ranging from Hv720 to 781. It is considered that the melting point of the metal paste No. 3 is about 1340° C.; however, it is judged that deep diffusion was obtained by alloying Ti with aluminum not by applying Ti alone

FOURTH PREFERRED EMBODIMENT

As the aluminum base material for being treated, an aluminum alloy plate (JIS5052) was used; as a metal paste, a blended paste of a metal paste No. 4 and a metal paste No. 6 at the ratio of 1:1 was used; and heat treatment was conducted at the temperature of 540° C.; and thus metal diffusion treatment was conducted.

Figure 4:
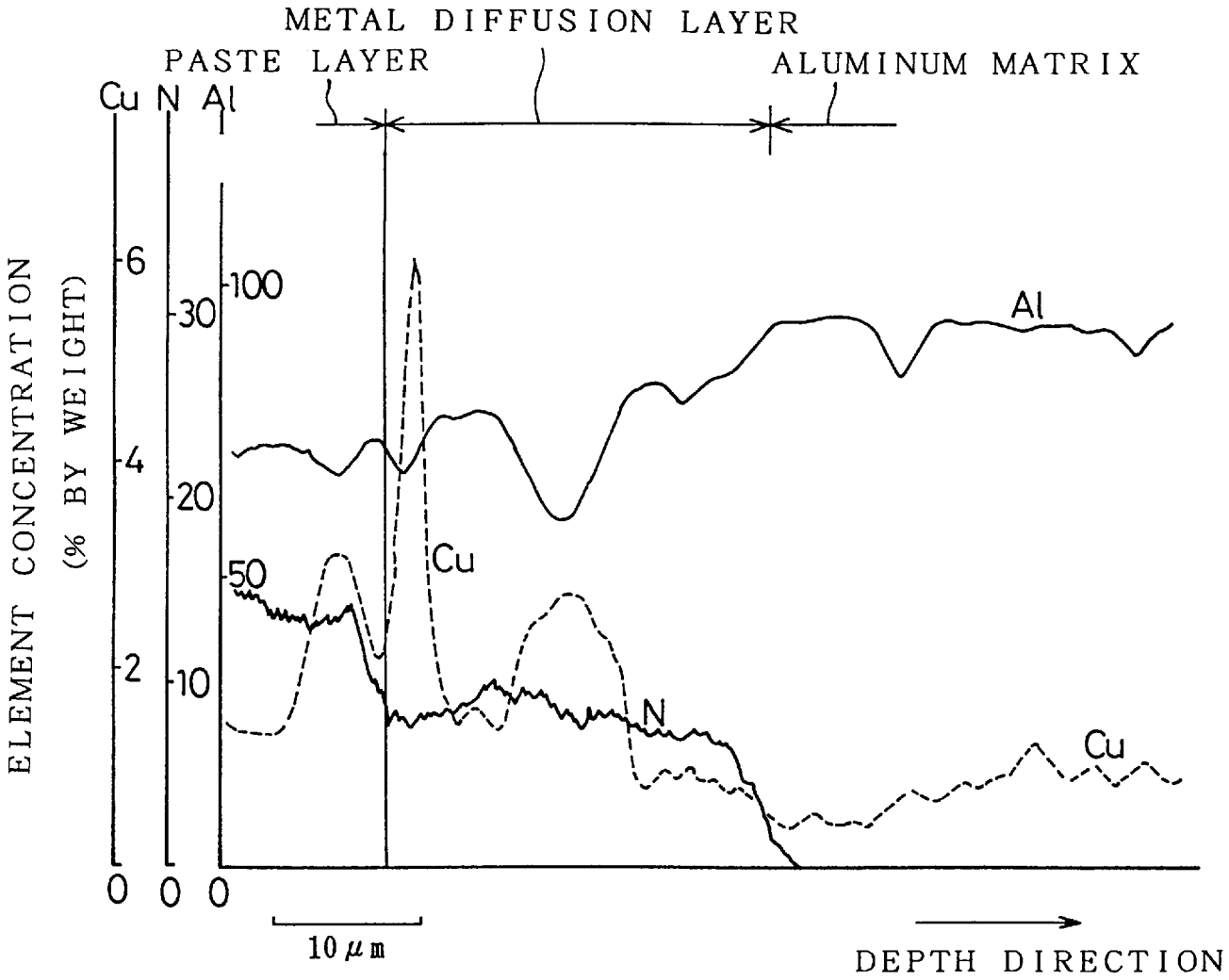
FIG. 4 is a chart for illustrating results of an EPMA, from the surface of the processing agent, to which the aluminum product having the metal diffusion layer obtained in a Fourth Preferred Embodiment of the present invention was subjected.

It was found that the surface of the obtained aluminum product has a brightness property of orange color. The resulting EPMA chart from the surface of the treatment agent is shown in FIG. 4. As can be seen from FIG. 4, when the whole of the metal diffusion layer is set to be 100% by weight, it was found that the amount of Cu is 6% by weight at the uppermost surface thereof and there exists Cu layer (depth; 28 $\mu$m which gradually inclines toward the inside thereof but which has the higher concentration portion on the way. Furthermore, it was found that there exists the nitriding layer whose width thereof is almost the same as that of this metal diffusion layer and whose nitrogen concentration is about 8% by weight at the uppermost surface layer exists. The hardness of the uppermost surface ranges from Hv248 to 282, which is lower compared with that of the Third Preferred Embodiment. This is because the hardness of Cu compound $CuAl_2$ is lower compared with that of Ti compound ($TiAl_3$).

FIFTH PREFERRED EMBODIMENT

As the aluminum base material for being treated, an aluminum alloy plate (JIS5052) was used; as a metal paste, a blended paste of metal paste No. 5 and a metal paste No. 2 at the ratio of 1:1 was used; and heat treatment was conducted at the temperature of 540° C.; and thus metal diffusion treatment was conducted.

Figure 5:
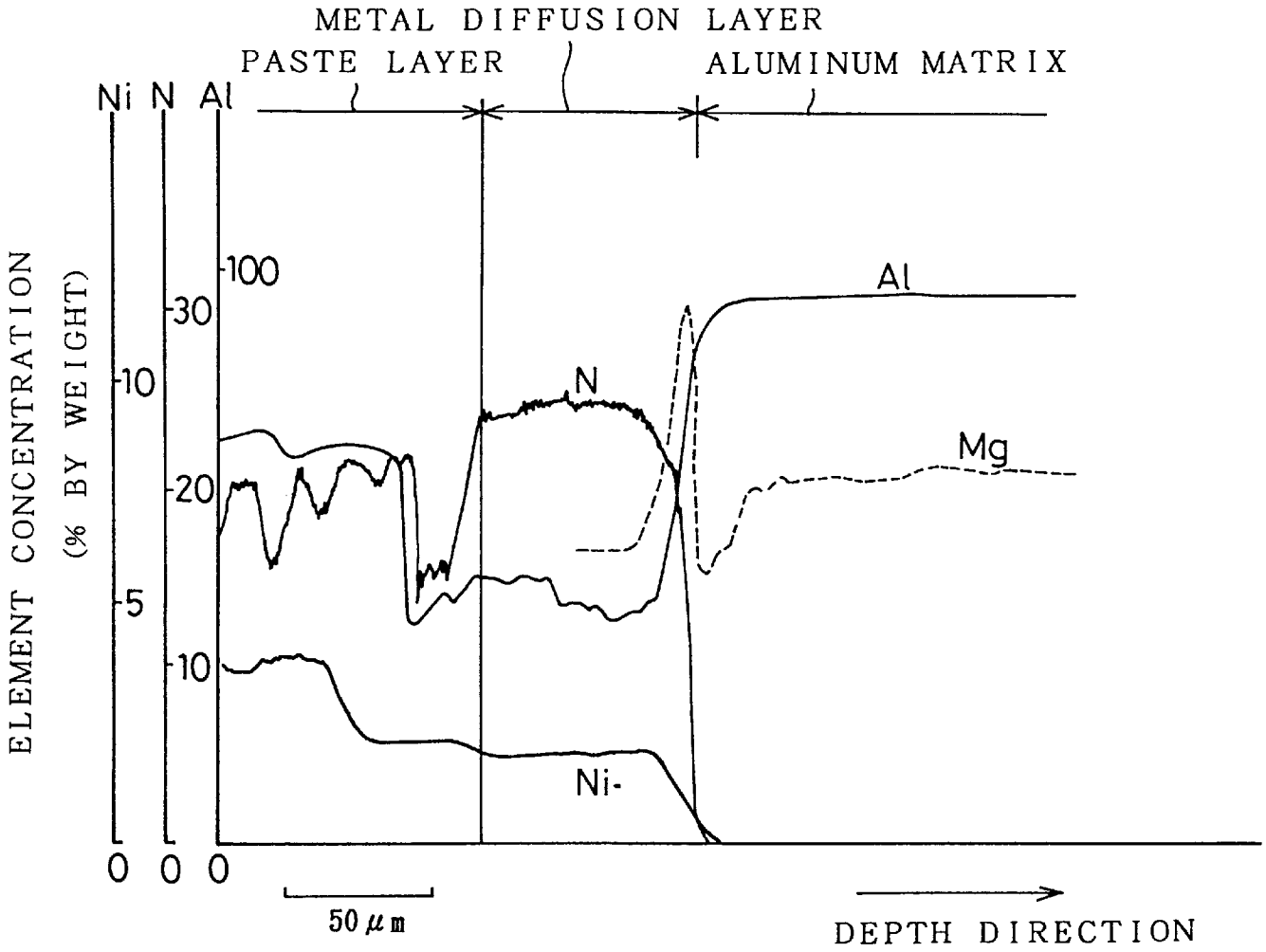
FIG. 5 is a chart for illustrating results of an EPMA, from the surface of the processing agent, to which the aluminum product having the metal diffusion layer obtained in a Fifth Preferred Embodiment of the present invention was subjected.

It was found that the surface of the obtained aluminum product has a brightness property of light blue color. The resulting EPMA chart from the surface of the treatment agent is shown in FIG. 5. As can be seen from FIG. 5, when the whole of the metal diffusion layer is set to be 100% by weight, it was found that there exists Ni layer (depth; 60 $\mu$m) in which the amount of Ni is 3% by weight at the uppermost surface thereof and in which Ni at the amount of 2.4% by weight exists evenly at the inside thereof. Furthermore, it was found that there exists the nitriding layer whose width thereof is almost the same as that of this metal diffusion layer and whose nitrogen concentration is about 9% by weight at the uppermost surface layer. The hardness of this metal diffusion layer ranges from Hv254 to 327.

Having now fully described the present invention, it will be apparent to one of ordinary skill in the art that many changes and modifications can be made thereto without departing from the spirit or scope of the present invention as set forth herein including the appended claims.

We claim:

1. An aluminum product having, on a surface thereof, a metal diffusion layer, comprising aluminum and a diffusion metal which is diffused to set aluminum as a matrix and which comprises nitrogen which is infiltrated and diffused into the metal diffusion layer from the surface thereof includes at least one diffusion metal selected from the group consisting of Ni, Cr, Cu, Zn, Ti and Ag; wherein said diffusion layer is formed by diffusing said diffusion metal inclinatorily not less than 1 $\mu$m from the surface thereof; and said diffusion metal is not less than 1.0% by weight when the whole of said metal diffusion layer is set to be 100% by weight.

2. A process for producing an aluminum product having, on a surface thereof, a metal diffusion layer comprising aluminum and at least one diffusion metal which is diffused therein to set aluminum as a matrix and wherein the diffusion metal is selected from the group consisting of Ni, Cr, Cu, Zn, Ti and Ag, comprising the steps of:

contacting the surface of said aluminum product with a processing agent including at least a powder of said diffusion metal; and heat treating said aluminum product with said processing agent in contact therewith in an atmosphere including nitrogen, so that said diffusion metal is diffused on the surface of said aluminum product such that the diffusion metal is diffused inclinatorily not less than 1 $\mu$m from the surface of the diffusion layer and the diffusion metal is not less than 1.0% by weight when the whole of said metal diffusion layer is set to be 100% by weight, and said metal diffusion layer is formed.

3. The process for producing an aluminum product having a metal diffusion layer according to claim 2, wherein said processing agent includes an alloy powder of said diffusion metal having a melting point which is lower than that of said diffusion metal.

4. The process for producing an aluminum product having a metal diffusion layer according to claim 3, wherein said alloy powder has a melting point ranging from 350 to 600° C.

5. The process for producing an aluminum product having a metal diffusion layer according to claim 3, wherein said alloy is an alloy of said diffusion metal and Mg or Al.

6. The process for producing an aluminum product having a metal diffusion layer according to claim 3, wherein said processing agent is a paste including a metal powder of said diffusion metal and an organic binder; and said contacting comprises coating said processing agent on the surface of said aluminum product.

7. The process for producing an aluminum product having a metal diffusion layer according to claim 2, wherein the atmosphere including said nitrogen comprises pure nitrogen.

8. The process for producing an aluminum product having a metal diffusion layer according to claim 2, wherein the heat treating is conducted at a temperature of from 400 to 600° C.

9. A paste for metal diffusion treatment comprising: a metal powder in an amount of 5 to 70% by weight including at least one diffusion metal selected from the goup consisting of Ni, Cr, Cu, Zn, Ti and Ag; an organic binder in an amount of 1 to 30% by weight; and the balance comprised substantially of solvent, wherein the paste contains the at least one diffusion metal in an amount sufficient to yield, on an aluminum product during the metal diffusion treatment, a metal diffusion layer containing not less than 1.0% by weight of the diffusion metal when the whole of the metal diffusion layer is set to be 100% by weight.

* * * * *